US011095057B2

(12) United States Patent
Parrish

(10) Patent No.: US 11,095,057 B2
(45) Date of Patent: Aug. 17, 2021

(54) CONTACT WITH A PRESS-FIT FASTENER

(71) Applicant: Interplex Industries, Inc., East Providence, RI (US)

(72) Inventor: Jeffrey D. Parrish, Plymouth, MI (US)

(73) Assignee: Interplex Industries, Inc., East Providence, RI (US)

( * ) Notice: Subject to any disclaimer, the term of this patent is extended or adjusted under 35 U.S.C. 154(b) by 0 days.

(21) Appl. No.: 16/649,315

(22) PCT Filed: Sep. 24, 2018

(86) PCT No.: PCT/US2018/052385

§ 371 (c)(1),
(2) Date: Mar. 20, 2020

(87) PCT Pub. No.: WO2019/067347

PCT Pub. Date: Apr. 4, 2019

(65) Prior Publication Data

US 2020/0280144 A1 Sep. 3, 2020

Related U.S. Application Data

(60) Provisional application No. 62/614,640, filed on Jan. 8, 2018, provisional application No. 62/564,573, filed on Sep. 28, 2017.

(51) Int. Cl.
*H01R 12/58* (2011.01)
*H01R 12/52* (2011.01)

(52) U.S. Cl.
CPC ..... *H01R 12/585* (2013.01); *H01R 12/523* (2013.01)

(58) Field of Classification Search
CPC ..... H01R 12/585; H01R 9/092; H01R 12/523
(Continued)

(56) References Cited

U.S. PATENT DOCUMENTS 3,634,819 A 1/1972 Evans
4,475,780 A 10/1984 Walter
(Continued)

FOREIGN PATENT DOCUMENTS

CN 103730742 4/2014
DE 19810897 C1 8/1999
(Continued)

OTHER PUBLICATIONS

International Search Report for PCT/US2018/052385, dated Nov. 15, 2018.
Written Opinion of the ISA for PCT/US2018/052385.

*Primary Examiner* — Gary F Paumen
(74) *Attorney, Agent, or Firm* — Katterle Nupp LLC; Paul Katterle; Robert Nupp

(57) ABSTRACT

An electrically conductive contact is disclosed and includes a fastening section integrally joined between a body and a tapered lead-in section. The fastening section is adapted for press-fitting into a hole of a substrate, such as a printed circuit board. The fastening section includes a pair of beams with a web joined in-between. The web has a center portion disposed between a pair of ramp portions. Each of the ramp portions has a sloping planar surface. The center portion has an opening extending therethrough and is offset in a normal direction. The fastening section is configured such that when the fastening section is press-fit into the hole of the substrate, the beams deflect both laterally and angularly.

19 Claims, 11 Drawing Sheets

(58) Field of Classification Search
USPC ..... 439/82, 751
See application file for complete search history.

(56) References Cited

U.S. PATENT DOCUMENTS

| | | | | |
|---|---|---|---|---|
| 4,768,980 | A | 9/1988 | Collier | |
| 4,793,817 | A | 12/1988 | Hiesbock | |
| 4,795,378 | A | 1/1989 | Tomizu | |
| 4,867,710 | A | 9/1989 | Harting | |
| 5,738,550 | A | 4/1998 | Sakuraoka | |
| 6,309,228 | B2 | 10/2001 | Otsuki | |
| 6,722,928 | B1 | 4/2004 | Noda | |
| 9,685,719 | B2 | 6/2017 | Uchida | |
| 2004/0029408 | A1* | 2/2004 | Brown, III | H01R 12/52 439/65 |
| 2009/0104823 | A1 | 4/2009 | Ludwig | |
| 2016/0268709 | A1* | 9/2016 | Zeigmeister | C25D 3/64 |
| 2016/0380367 | A1* | 12/2016 | Miyake | H05K 3/325 174/266 |
| 2020/0028287 | A1 | 1/2020 | Bogursky | |

FOREIGN PATENT DOCUMENTS

| | | | |
|---|---|---|---|
| DE | 102009060739 | A1 | 7/2011 |
| EP | 0092150 | A2 | 10/1983 |

* cited by examiner

CONTACT WITH A PRESS-FIT FASTENER

CROSS-REFERENCE TO RELATED APPLICATION(S)

This application is the U.S. national phase of PCT Application No. PCT/US2018/052385 filed on Sep. 24, 2018, which claims priority under 35 U.S.C. § 119(e) to Provisional Patent Application No. 62/564,573, filed on Sep. 28, 2017, and Provisional Patent Application No. 62/614,640, filed on Jan. 8, 2018, all of which are incorporated herein by reference.

BACKGROUND

The present disclosure relates to an electrical contact and more particularly to an electrical contact having a fastener adapted to be press-fit into a hole of a substrate, such as a printed circuit board (PCB).

In electronic systems utilizing one or more PCBs, a PCB is often electrically connected to other electrical devices (such as other PCBs) by electrical connectors. In many instances, an electrical connector will utilize a plurality of contacts, each having at least one end portion that is fixed in an electrically conductive (plated) hole of the PCB. Such an end portion may be secured within the plated hole by soldering or by a resilient fastener. In the latter instance, the resilient fastener is typically referred to as a press-fit fastener.

Conventionally, a press-fit fastener plastically and elastically deforms as it is inserted into the PCB hole. This deformation creates a retention force that holds the fastener in the PCB hole. A number of different types of construction have been used for the fastener, one of which is known as an "eye of the needle" (EON) type of construction. In this type of construction, an opening or piercing is formed in the fastener so as to define a pair of beams that are resiliently movable toward and away from each other to provide a normal force against the PCB hole. Another type of construction used for the fastener utilizes beams that are connected together by a web that permits the beams to roll inward to conform to the PCB hole.

Conventional EON press-fit fasteners provide a limited contact area with a plated hole of a PCB, while conventional web press-fit fasteners are difficult to manufacture and experience significant plastic deformation. As such, it would be desirable to provide an improved press-fit fastener that is easier to manufacture and has an increased contact area with a plated hole of a PCB.

SUMMARY

An electrically conductive contact is disclosed. The contact includes a conductive body and a lead-in section having a tapered tip. A fastening section is integrally joined between the body and the lead-in section. The fastening section has a longitudinal axis and is adapted for press-fitting into a hole of a substrate, such as a printed circuit board. The fastening section includes a pair of beams extending in the direction of the longitudinal axis between the body and the lead-in section. The beams have thicknesses in the normal direction with midpoints disposed in a plane extending in the direction of the longitudinal axis. A web is joined between the pair of beams. At least a portion of the web is offset in the normal direction such that the portion is not intersected by the plane. The fastening section is configured such that when the fastening section is press-fit into the hole of the substrate, the beams pivot inward about axes extending parallel to the longitudinal axis.

In one aspect of the disclosure, one or more openings extend through the web in a direction normal to a longitudinal axis of the fastening section. The one or more openings are not intersected by the plane.

In another aspect of the disclosure, the web has a center portion disposed between a pair of ramp portions. Each of the ramp portions has a planar surface disposed at an angle to the plane. The center portion is offset in the normal direction such that the center portion is not intersected by the plane.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
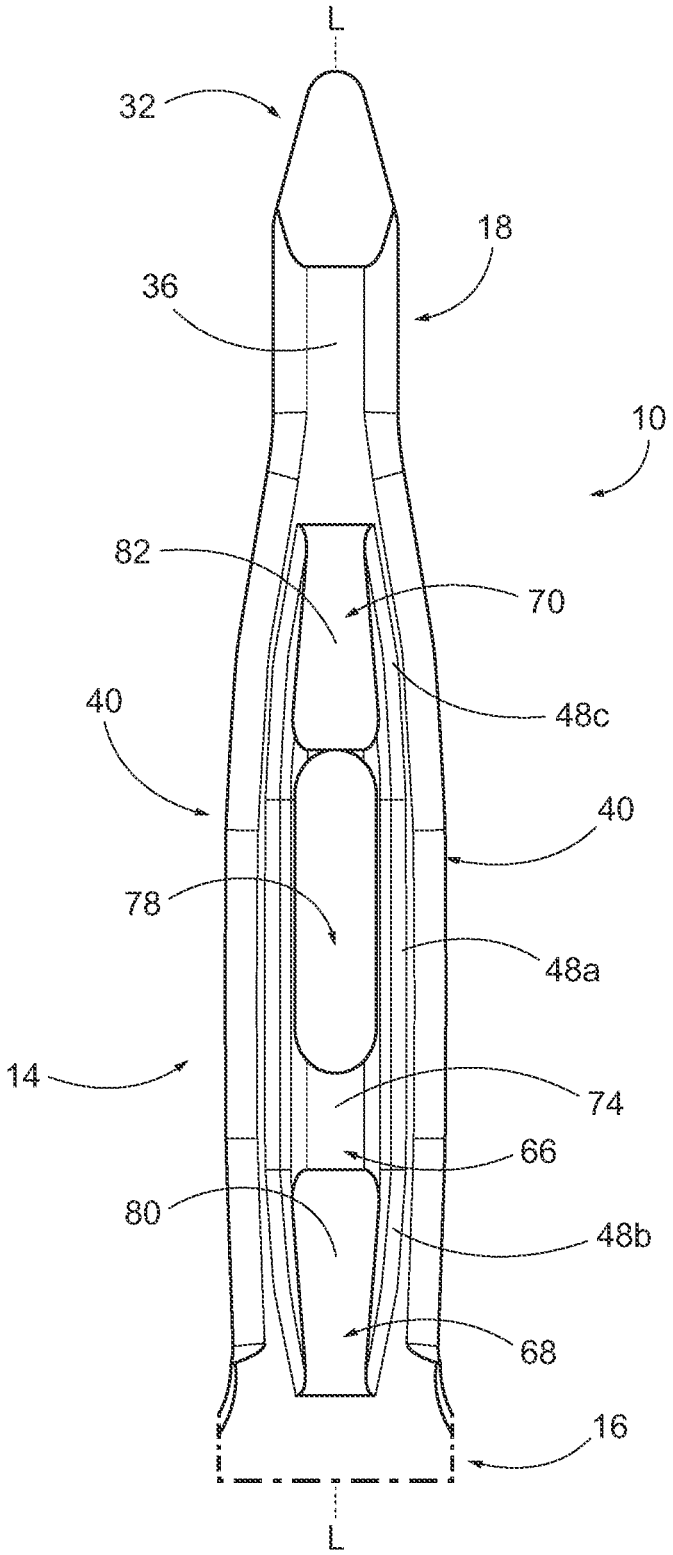
FIG. 1 shows a plan view of a portion of a contact having a first embodiment of a fastening section.

It should be noted that in the detailed descriptions that follow, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Spatially relative terms, such as "top", "bottom", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the drawings.

Referring now to FIG. 1, there is shown a portion of a contact 10 constructed in accordance with this disclosure. The contact 10 has a unitary or monolithic structure and includes a fastening section 14 integrally joined between a body 16 and a lead-in section 18. As will be more fully described below, the fastening section 14 is adapted for insertion into, and retention within, a plated hole 92 in a PCB 90 (shown in FIGS. 5 and 7) so as to form a secure electrical connection therewith. The configuration of the body 16 depends on the particular application of the contact 10. As such, the body 16 may have many different configurations.

Figure 2:
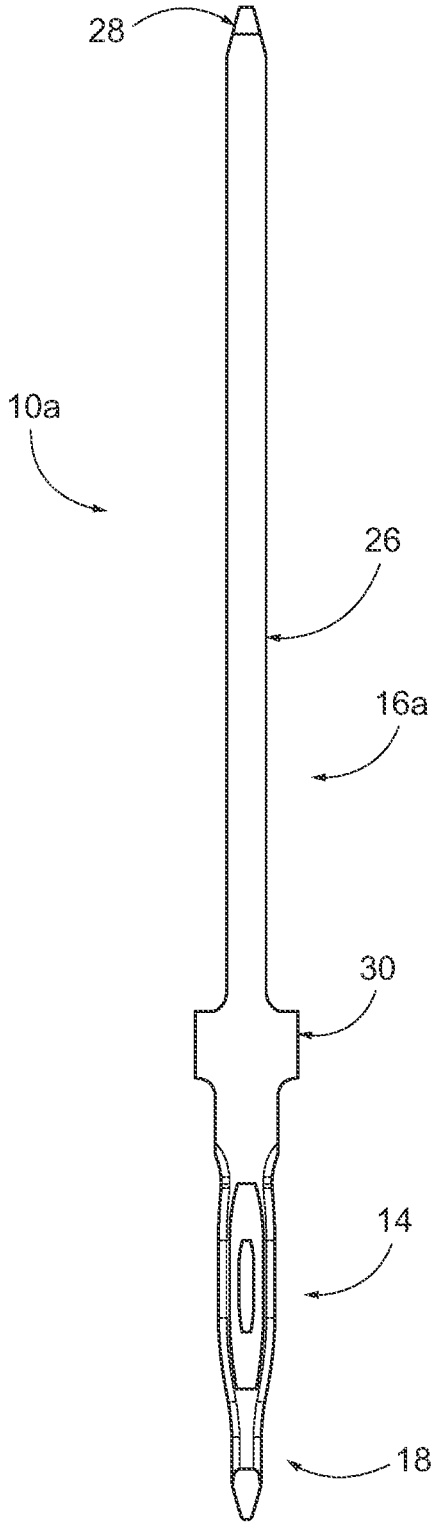
FIG. 2 shows a plan view of a first embodiment of the contact.
Figure 3:
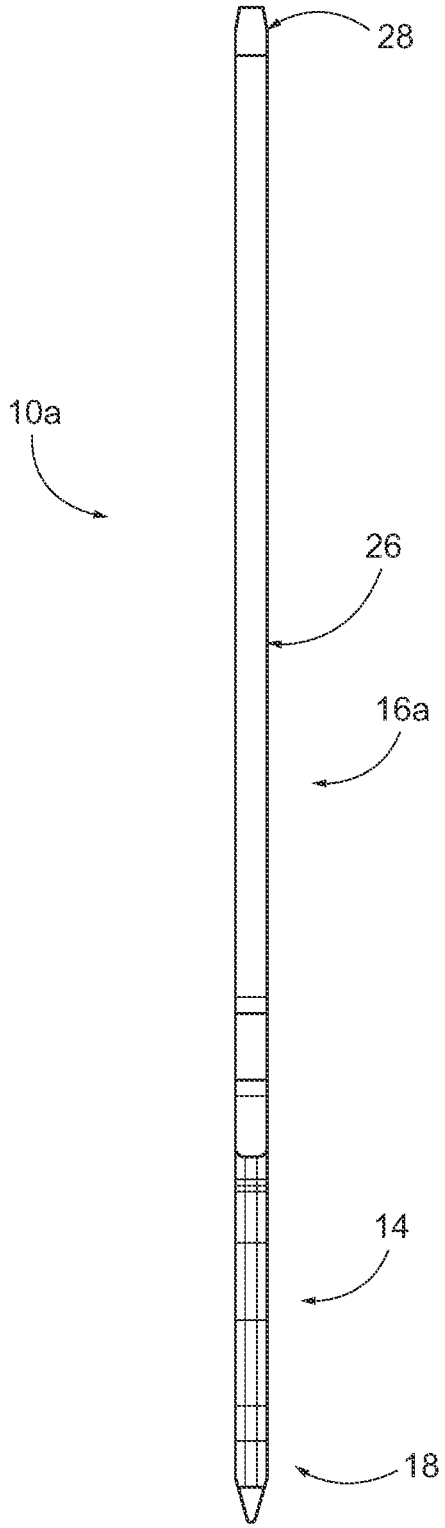
FIG. 3 shows a side view of the first embodiment of the contact shown in FIG. 2.

One general application for the contact 10 may be a simple pin terminal. For this general application, the contact may take the form of the embodiment designated by the numeral 10*a*, which is shown in FIGS. 2 and 3 and to which reference is now made. In contact 10*a*, the body may take the form of the embodiment designated by the numeral 16*a*, which includes an elongated pin 26 adapted for insertion into a female connector (not shown) so as to make an electrical connection. The pin 26 has a free end 28, distal to the fastening section 14, that is tapered to facilitate insertion. Depending on the specific application, the pin 26 may have one or more retention structures (not shown) arranged around the circumference of the pin 26. The retention structure(s) may be used to secure the pin to a connector housing or other type of component or part. A shoulder 30 may be joined to the pin 26, proximate to the fastening section 14. The shoulder 30 provides surfaces against which a force may be applied to insert the fastening section 14 into the hole 92 of the PCB 90, or other substrate.

The contact 10*a* may be formed from lengths of metal wire having a rectangular cross-section, or from flat stock. The size of the wire or flat stock that is used depends on the application of the contact 10*a*. However, the structure of the contact 10*a* is well suited for utilizing small size wire (e.g. a diameter or width of less than 0.018 inches) to produce small contacts 10*a*. Although the contact 10*a* and its method of manufacture are well suited for this application, it should be appreciated that they can be used for other applications using larger size wire or using flat stock to produce different size contacts 10*a*. For example, wire or flat stock may be used having a width of 0.018 inches or greater, such as 0.025 inches, or 0.045 inches, or any other dimension suitable for a particular application, such as use in a PCB. A contact 10*a* for a typical PCB application with small holes will have a fastening section 14 with a width (undeformed) in a range of from about 0.016 inches (0.4 mm) to about 0.024 inches (0.6 mm).

Figure 4:
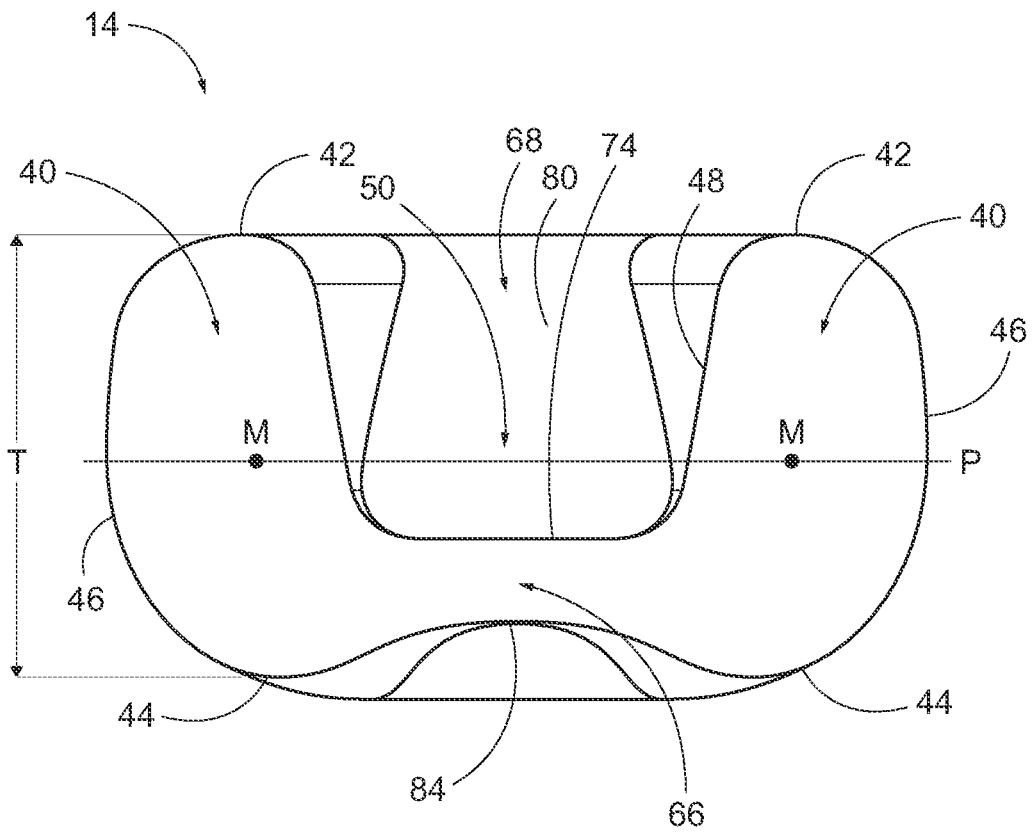
FIG. 4 shows a sectional view of the fastening section.
Figure 5:
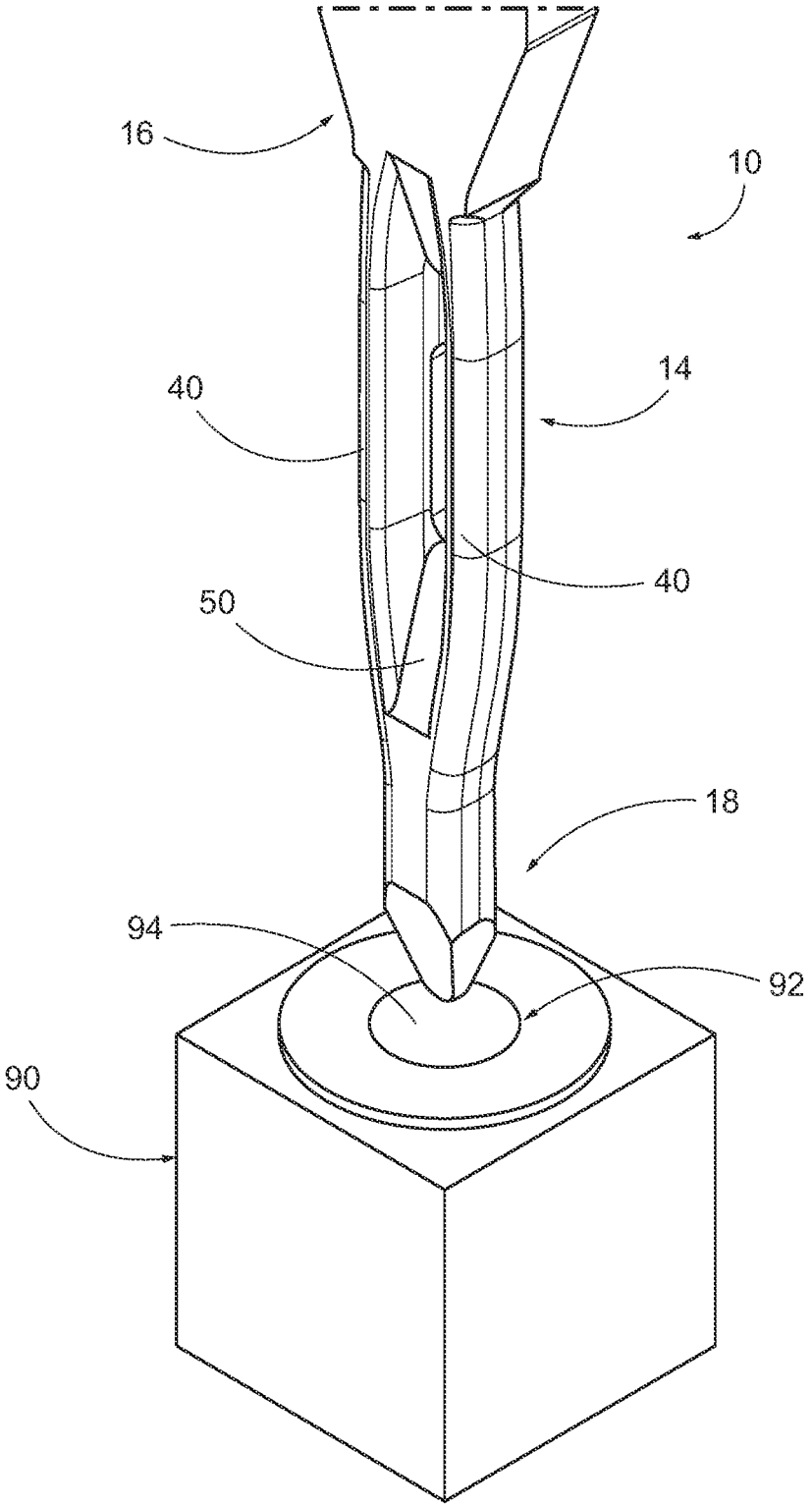
FIG. 5 shows a perspective view of a portion of the contact positioned above a hole in a printed circuit board.

Referring back to FIG. 1 and now also to FIGS. 4 and 5, the lead-in section 18 includes an outer tip 32, which is solid. The tip 32 is tapered to have opposing major and minor surfaces that incline toward each other to form a blunted point. The taper of the tip 32 facilitates the insertion of the fastening section 14 into the hole of a PCB. The tip 32 adjoins a top surface 36 and an opposing bottom surface (not shown), which are parallel to each other and extend in a longitudinal direction.

The fastening section 14 has a longitudinal axis L and a pair of elongated beams 40 that are disposed parallel to each other in a lateral direction. The beams 40 extend in the direction of the longitudinal axis, between the body 16 and the lead-in section 18. From the lead-in section 18, the beams 40 curve or bow laterally outward such that in the lateral direction, the maximum width of the fastening section 14 is greater than the maximum width of the lead-in section 18. The beams 40 each have upper and lower surfaces 42, 44 that extend between the body 16 and the lead-in section 18. In each beam 40, the upper and lower surfaces 42, 44 delimit a thickness T of the beam 40. Midpoints M of the thicknesses T are disposed in a reference plane P that extends in the direction of the longitudinal axis.

Each of the beams 40 also has an outer side surface 46 and an inner side surface 48. The outer side surface 46 is joined between the upper and lower surfaces 42, 44, while the inner side surface 48 is joined between the upper surface 42 and a web 50. Both the outer and inner side surfaces 46, 48 extend between the body 16 and the lead-in section 18 and are joined to the outer side surfaces 46 at rounded edges, respectively. The outer side surfaces 46 are also joined to the lower surfaces 44 at rounded edges. Each outer side surface 46 has, in the direction of the longitudinal axis, a center portion disposed between inner and outer portions. In the direction of the longitudinal axis, the outer portion and, to a significantly lesser extent, the inner portion are arcuate, while the center portion is substantially straight. Similar to the outer side surfaces, each inner side surface 48 has, in the direction of the longitudinal axis, a center portion 48*a* disposed between inner and outer portions 48*b,c*. In the direction of the longitudinal axis, the outer portion 48*c* and the inner portion 48*b* are arcuate, while the center portion 48*a* is substantially straight. In this manner, the inner side surfaces 48 generally delineate the outline of a canoe, as viewed from the top, and, thus, provide the web 50 with a canoe shape.

The web 50 extends laterally between the two beams 40 and longitudinally along the lengths of the beams 40. Opposing edges of the web 50 are joined to the inner surfaces 48 of the beams 40 at rounded curves. The web 50 has a center section 66 disposed between inner and outer ramp sections 68, 70. The lengths of the inner and outer ramp sections 68, 70 in the direction of the longitudinal axis are about the same, while the center section 66 is longer, typically from about 1.4 to about 2.4 times, the length of the inner ramp section 68 (or outer ramp section 70). In one embodiment, the inner and outer ramp sections 68, 70 are each more than half the length of the center section 66.

The center section 66 has a planar top surface 74 that extends in a plane parallel to the longitudinal axis. An interior wall defines a piercing or opening 78 that extends through the center section 66, toward the outer ramp section 70. The opening 78 may be a circular hole, a slot or other opening shape. However, in the shown embodiment, the interior wall and, thus, the opening 78 each have an elongated elliptical shape. The opening 78 extends through the web 50 in a direction normal to the longitudinal axis and the reference plane P. The center section 66 (including the interior wall and the opening 78) is disposed below the reference plane P of the fastening section 14. In other words, the center section 66 of the web 50 is offset in the normal direction and is disposed toward the lower surfaces 44 of the beams 40.

The inner ramp section 68 of the web 50 is disposed between the body 16 and the center section 66, while the outer ramp 70 portion of the web 50 is disposed between the center section 66 and the lead-in section 18. A top surface 80 of the inner ramp section 68 slopes downward as the inner ramp section 68 extends from the body 16 toward the center section 66, while a top surface 82 of the outer ramp section 70 slopes upward as the outer ramp section 70 extends from the center section 66 to the lead-in section 18. The top surface 80 of the inner ramp section 68 is planar and has a slope of about 20 degrees. The top surface 82 of the outer ramp section 70 is also planar and has a slope of about 20 degrees. A bottom surface 84 of the web 50 is concave and is seemlessly joined between the lower surfaces 44 of the beams 40, which slope upward. In this manner, the bottom of the fastening section 14 is also concave.

The configuration of the fastening section 14 described above provides the fastening section 14 with the ability to resiliently deform both laterally and angularly. The opening and the thinness of the web 50 permit the beams 40 to resiliently move toward and away from each other in the lateral direction when laterally-inward forces are applied to the beams 40. The configuration of the web 50, with its canoe shape and offset center section 66, permits the beams 40 to pivot inwardly about axes parallel to the longitudinal axis when laterally-inward forces are applied to the beams 40. The amount of lateral and angular deformation that occurs when laterally-inward forces are applied to the beams 40 varies in the direction of the longitudinal axis due to the inner and outer ramp sections 68, 70. As the inner and outer ramp sections 68, 70 extend toward the center section 66, the thickness of the web 50 decreases, which permits increased lateral and pivoting movement of the beams 40. In this manner, the fastening section 14 has a deformation profile in the direction of the longitudinal axis in which the amount of deformation (both lateral and angular) of the fastening section 14 increases as the fastening section 14 extends from the lead-in section 18 to the opening 78, where it is at a maximum, and then decreases as the fastening section 14 extends from the opening 78 to the body 16. In this regard, it should be noted that the location of the opening 78 proximate the outer ramp 70 allows for lowering the peak insertion forces when the full width of the fastening section 14 makes initial contact with a PCB hole, thus lowering the bucking forces transmitted to the body 16.

It should be appreciated that the deformation characteristics of the fastening section 14, including its deformation profile, can be modified or tailored to better suit a particular application or to accommodate or take advantage of a particular manufacturing process. For example, the location of the opening 78 may be changed and/or its dimensions modified to reduce or increase its length and/or reduce its width; such modification changing the mechanical properties of the fastening section 14. For instance, increasing the length of the opening 78 tends to decrease both the required insertion force and the retention forces. In addition, the length, shape and slope of the inner and outer ramp 68, 70 may also be modified. Still further, multiple openings may be formed in the web 50. Additional illustrative embodiments, having multiple and differently arranged openings are described below.

The operation of the contact 10 will now be more fully described with regard to the securement of the contact 10 to the PCB 90. As shown in FIG. 5, the lead-in section 18 is aligned above the plated hole 92 in the PCB 90. The hole 92 is defined by a continuous interior wall 94 of the PCB 90. A downward force is applied to the body 16 of the contact 10, such as to the shoulders 30. The lead-in section 18 faciley enters the hole 92, followed by the fastening section 14. Since the fastening section 14 is laterally wider than the diameter of the hole 92, the arcuate outer side surfaces 46 of the beams 40 contact the interior wall 94 of the PCB 90, thereby translating some of the downward force into inwardly-directed lateral forces. These lateral forces cause the beams 40 to move laterally inward toward each other, i.e., the fastening section 14 deforms laterally inward. In addition, the inward forces cause the beams 40 to pivot inward about axes parallel to the longitudinal axis, i.e., the fastening section 14 deforms angularly. The lateral and angular deformation of the fastening section 14 permits the fastening section 14 to enter and be securely disposed within the hole 92. Inside the hole 92, the beams 40 apply laterally outward forces against the interior wall 94. In addition, the beams 40 apply angular forces against the interior wall 94 (components of which include lateral and normal forces). The forces applied by the beams 40 frictionally secure the fastening section 14 within the hole 92.

Figure 6A:
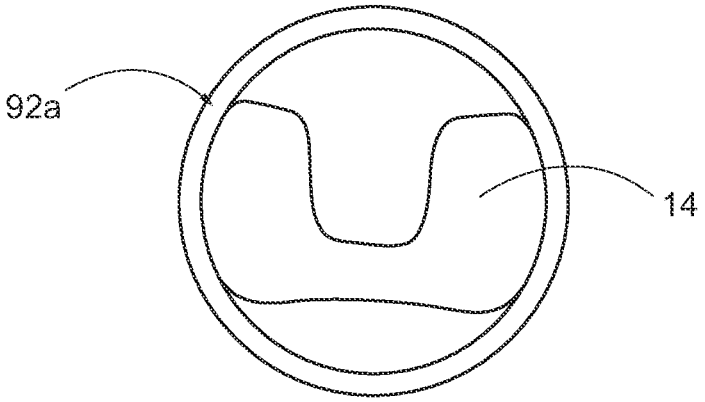
FIGS. 6*a,b,c* show sectional views of of the fastening section disposed in PCB holes of different sizes.
Figure 6B:
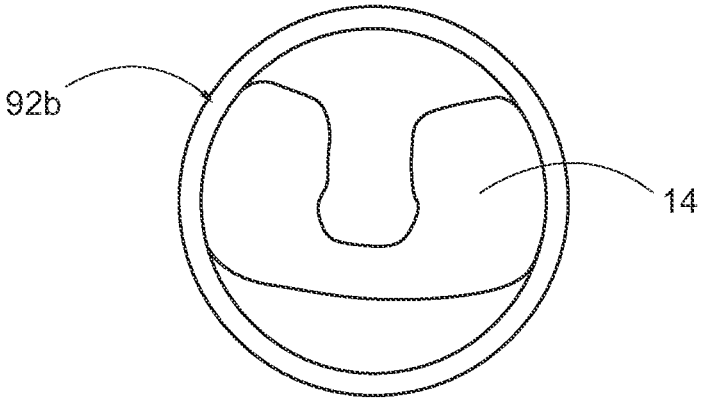
Figure 6C:
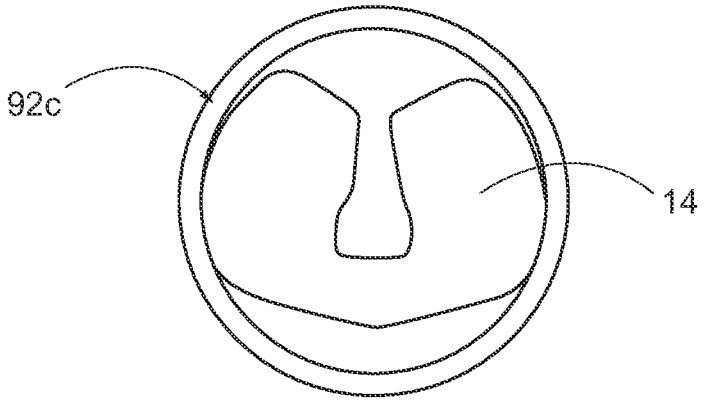

The deformation of the fastening section 14 in PCB holes of different sizes is shown in FIGS. 6*a,b,c* to which reference is now made. FIG. 6*a* shows a sectional view of the fastening section 14 disposed in a PCB hole 92*a*, which has a maximum diameter, relative to a nominal size of the fastening section 14. As shown in FIG. 6*a*, the fastening section 14 has only a small amount of deformation. FIG. 6*b* shows a sectional view of the fastening section 14 disposed in a PCB hole 92*b*, which has a nominal diameter relative to the nominal size of the fastening section 14. As shown in FIG. 6*b*, the fastening section 14 has noticably deformed, both laterally and angularly. The beams 40 have moved laterally inward toward each other such that the width of the web 50 between the beams 40 has decreased. In addition, the beams 40 have pivoted inward toward each other such that an upper space between the tops of the inner side surfaces 48 of the beams 40 has decreased by an amount greater than the decrease in the width of the web 50. Indeed, the upper space is now only a little greater than the width of the web 50. FIG. 6*c* shows a sectional view of the fastening section 14 disposed in a PCB hole 92*c*, which has a minimum diameter relative to the nominal size of the fastening section 14. As shown in FIG. 6*c*, the fastening section 14 has significantly deformed, especially angularly. The beams 40 have moved laterally inward toward each other such that the width of the web 50 between the beams 40 has decreased slightly. The beams 40, however, have significantly pivoted inward toward each other such that the upper space has significantly decreased. Indeed, the upper space is now less than half the width of the web 50.

Figure 7:
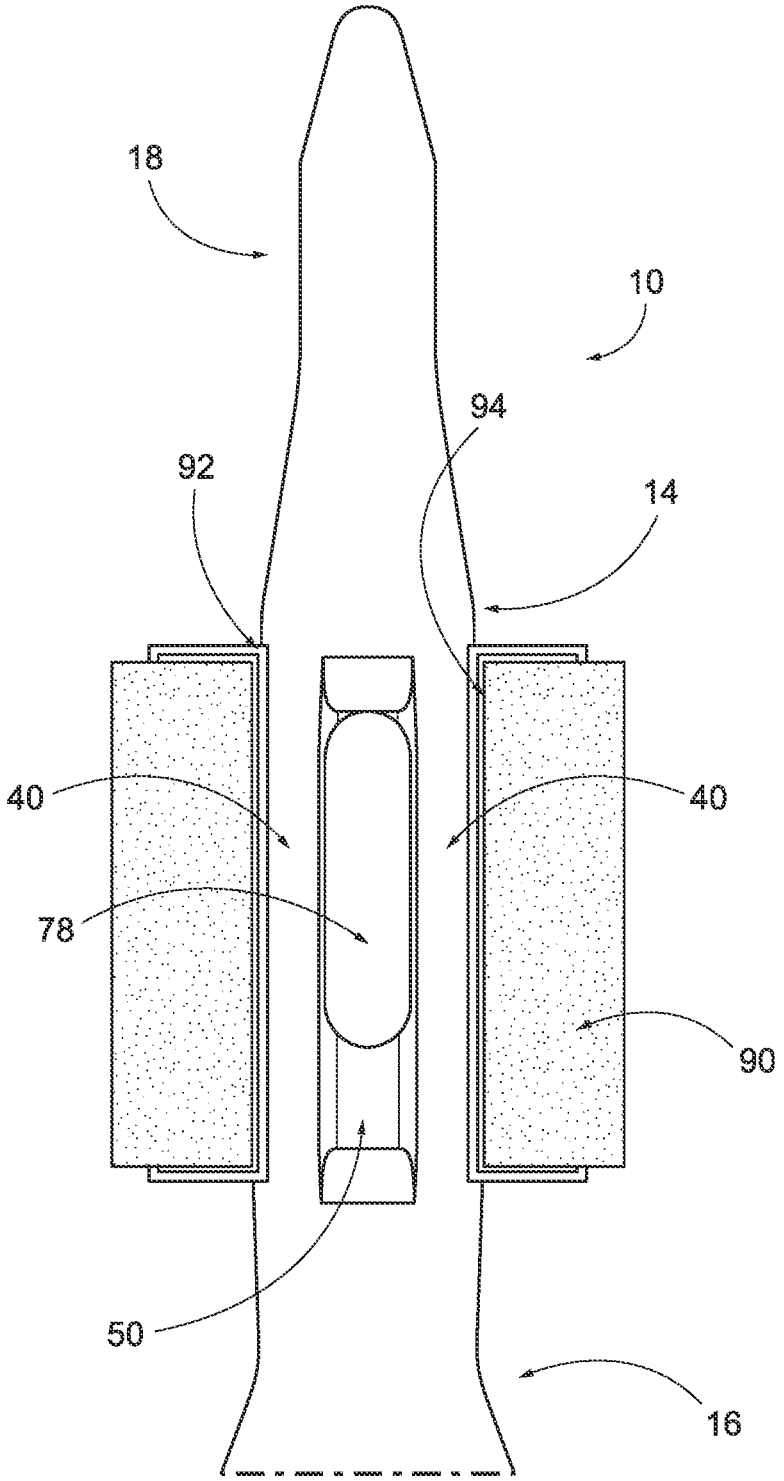
FIG. 7 shows a sectional view of a portion of the contact disposed in the hole in the printed circuit board.

Referring now to FIG. 7, the contact 10 is shown mounted to the PCB 90. A substantial portion of the fastening section 14 is disposed in the hole 92. The beams 40 are deformed both laterally and angularly. As a result of their deformation, both of the beams 40 engage a substantial portion of the length of the interior wall 94. This enhanced frictional engagement increases the retention forces securing the fastening section 14 in the hole 92.

Figure 8:
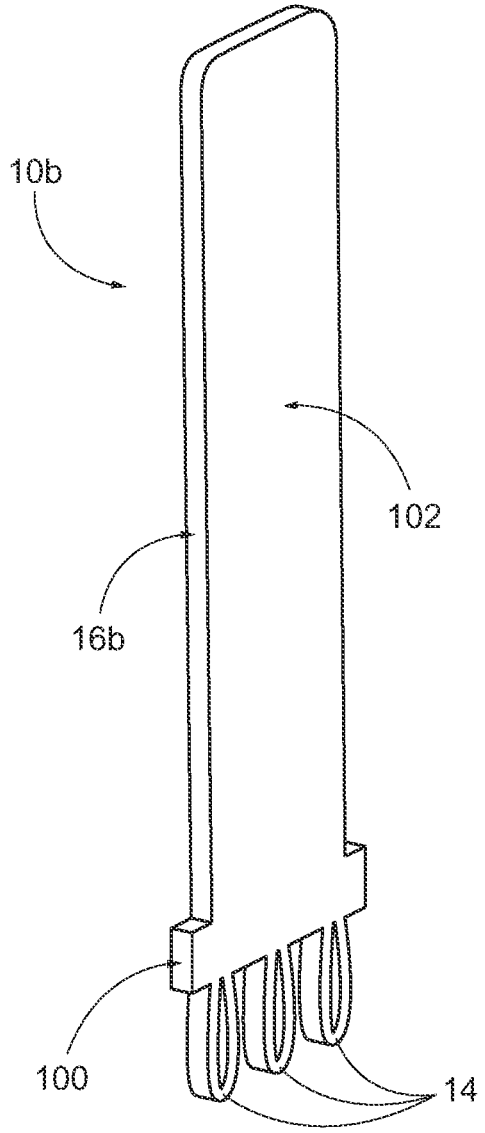
FIG. 8 shows a perspective view of a second embodiment of the contact.

Referring now to FIG. 8, there is shown a contact 10*b* that is constructed in accordance with another embodiment of the disclosure. The contact 10*b* generally includes a body 16*b* joined to a plurality of the fastening sections 14. The body 16*b* includes a shoulder 100 joined to an elongated blade 102 having opposing planar surfaces and a beveled free end.

Figure 9:
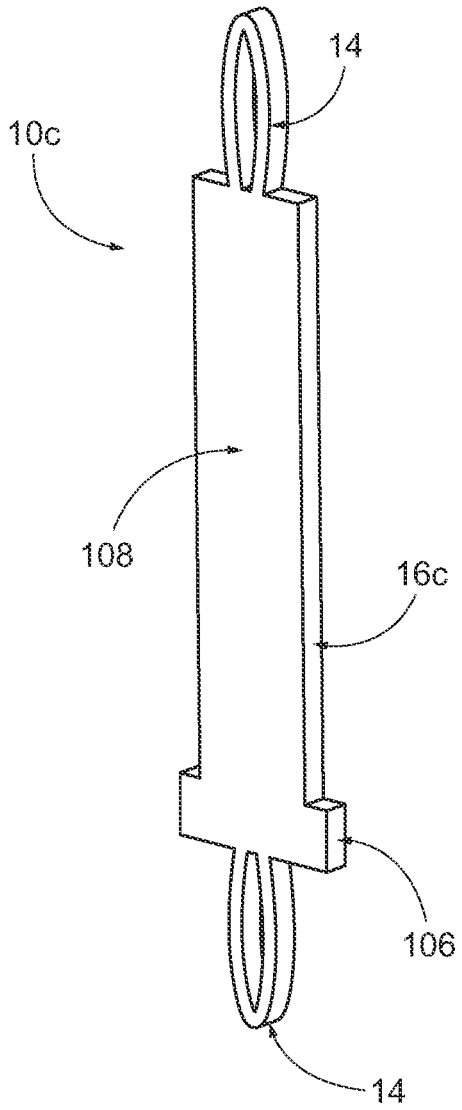
FIG. 9 shows a perspective view of a third embodiment of the contact.

Referring now to FIG. 9, there is shown a contact 10*c* that is constructed in accordance with still another embodiment of the disclosure. The contact 10*c* includes a body 16*c* joined between two of the fastening structures 14. The body 16*c* includes a shoulder 106 joined between a first end of an elongated blade 108 and a first one of the fastening sections 14. A second end of the blade 108 is joined to a second one of the fastening sections 14. The blade 108 includes opposing planar surfaces.

It should be appreciated that the body 16 may have configurations other than the bodies 16*a*, 16*b*, 16*c*, shown and described above. For example, the body 16 may have a tuning fork configuration or may be bent into a right angle, or have any other type of configuration.

Referring now to FIGS. 10-15, there are shown embodiments of a contact (generally designated by the numeral 110) having the same construction as the contact 10, except, instead of having a fastening section 14, the contact 110 has a fastening section (generally designated by the numeral 114). In the same manner as the fastening section 14, the fastening section 114 is integrally joined between the body 16 and the lead-in section 18. The fastening section 114 has a construction similar to the fastening section 14, except for the differences described below.

The fastening section 114 has beams 116, similar to the beams 40, except each of the beams 116 has an inner side surface 118, instead of an inner side surface 48. The inner side surface 118 is joined between the upper surface 42 and a web 120. Both the outer and inner side surfaces 46, 118 extend between the body 16 and the lead-in section 18 and are joined to the outer side surfaces 46 at rounded edges, respectively. In the direction of the longitudinal axis, the inner side surfaces 118 are generally linear, as opposed to being generally arcuate, like the inner side surfaces 48.

The web 120 extends laterally between the two beams 116 and longitudinally along the lengths of the beams 116. Opposing edges of the web 120 are joined to the inner side surfaces 118 of the beams 116. The web 120 has a center section 122 disposed between inner and outer ramp sections 124, 126. The inner ramp section 124 of the web 120 is disposed between the body 16 and the center section 122, while the outer ramp section 126 of the web 120 is disposed between the center section 122 and the lead-in section 18. A top surface of the inner ramp section 124 slopes downward as the inner ramp section 124 extends from the body 16 toward the center section 122, while a top surface of the outer ramp section 126 slopes upward as the outer ramp section 126 extends from the center section 122 to the lead-in section 18. The outer ramp section 126 is substantially smaller than the inner ramp section 124.

The center section 122 has a planar top surface that extends in a plane parallel to the longitudinal axis. One or more piercings or openings extend through the center section 122 in a direction normal to the longitudinal axis and the reference plane P. The opening(s) may be one, two, three, four or more in number. In addition, the opening(s) may be circular, elliptical or any other suitable shape. In embodiments having multiple openings, the shapes of the openings may be the same or different. For purposes of illustration and not limitation, embodiments with different opening configurations are shown in FIGS. 10 & 11, FIGS. 12 & 13 and FIGS. 14 & 15, respectively.

Figure 10:
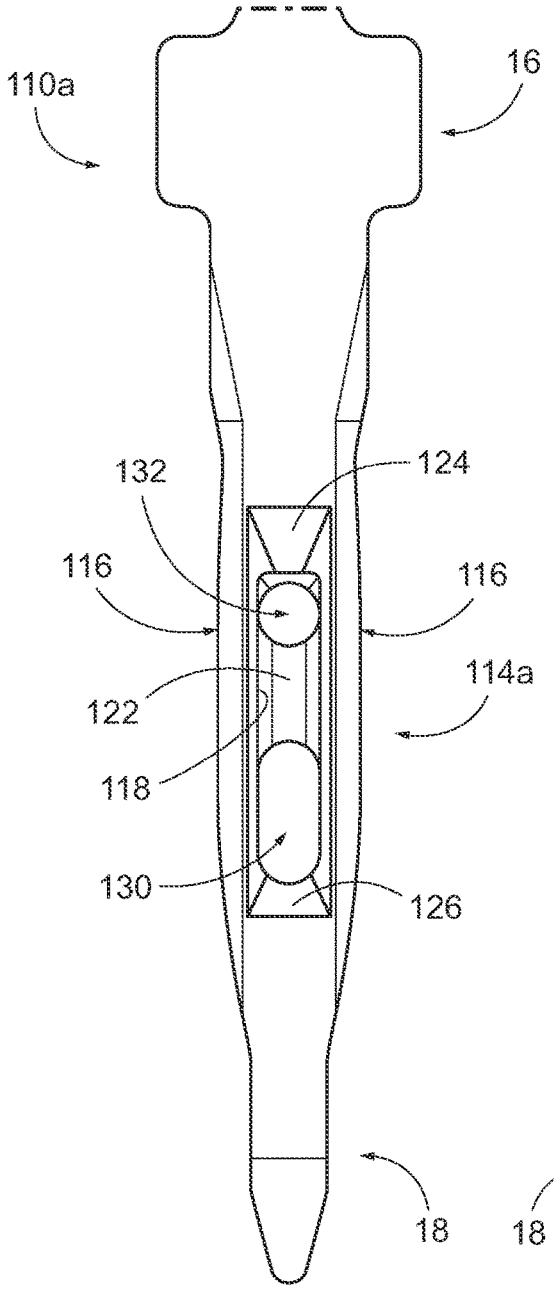
FIG. 10 shows a plan view of a second embodiment of the fastening section.
Figure 11:
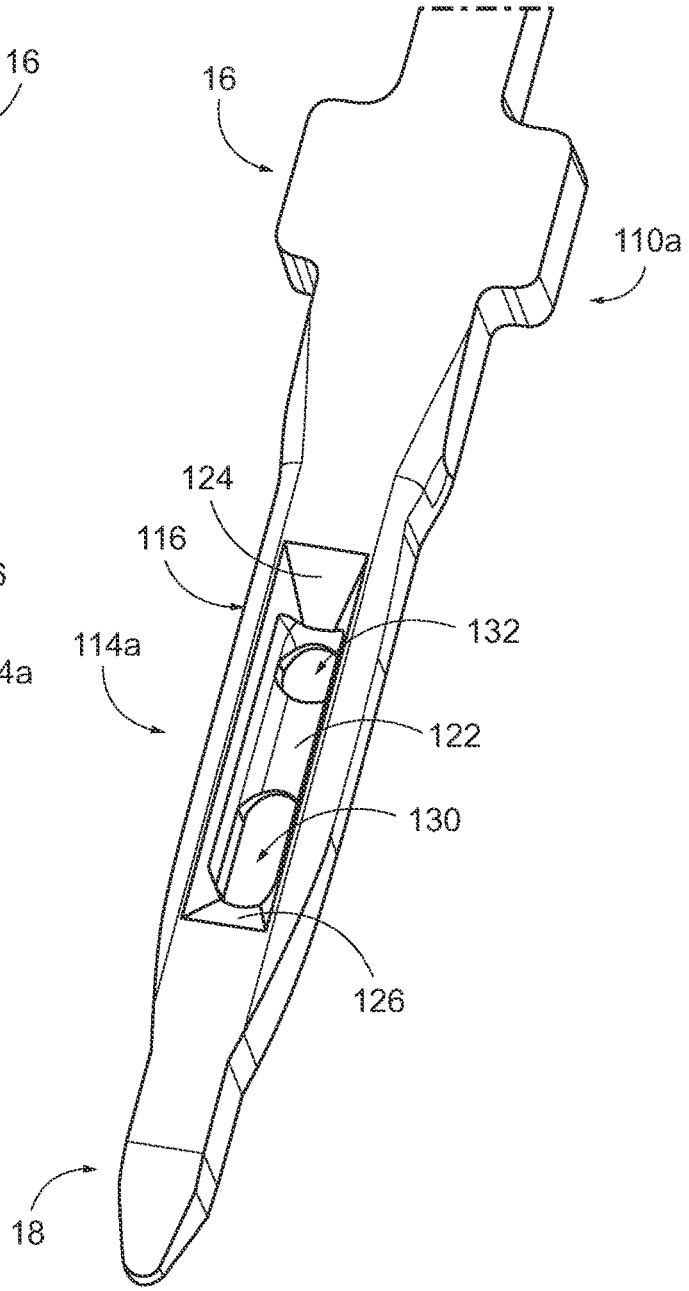
FIG. 11 shows a perspective view of the second embodiment of the fastening section.

In FIGS. 10 & 11, the fastening section 114*a* of the contact 110*a* is shown having a first piercing or opening 130 and a second piercing or opening 132 extending through the center section 122. The first opening 130 has an elliptical shape and is disposed proximate to the outer ramp section 126, while the second opening 132 has a circular shape and is disposed proximate to the inner ramp section 124. The first opening 130 is substantially larger than the second opening 132.

Figure 12:
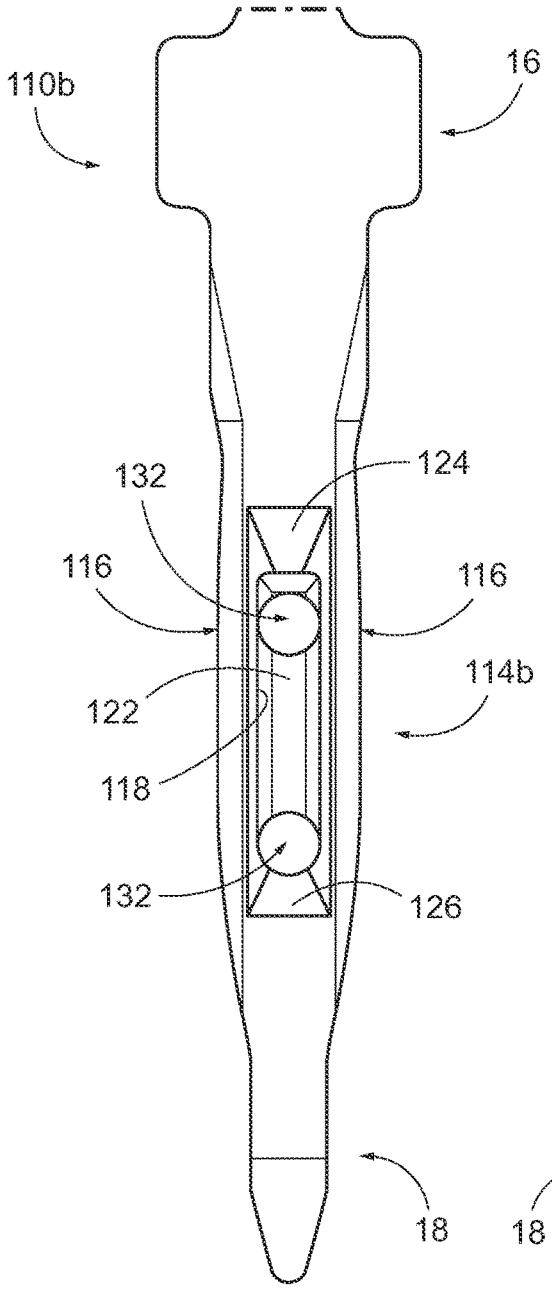
FIG. 12 shows a plan view of a third embodiment of the fastening section.
Figure 13:
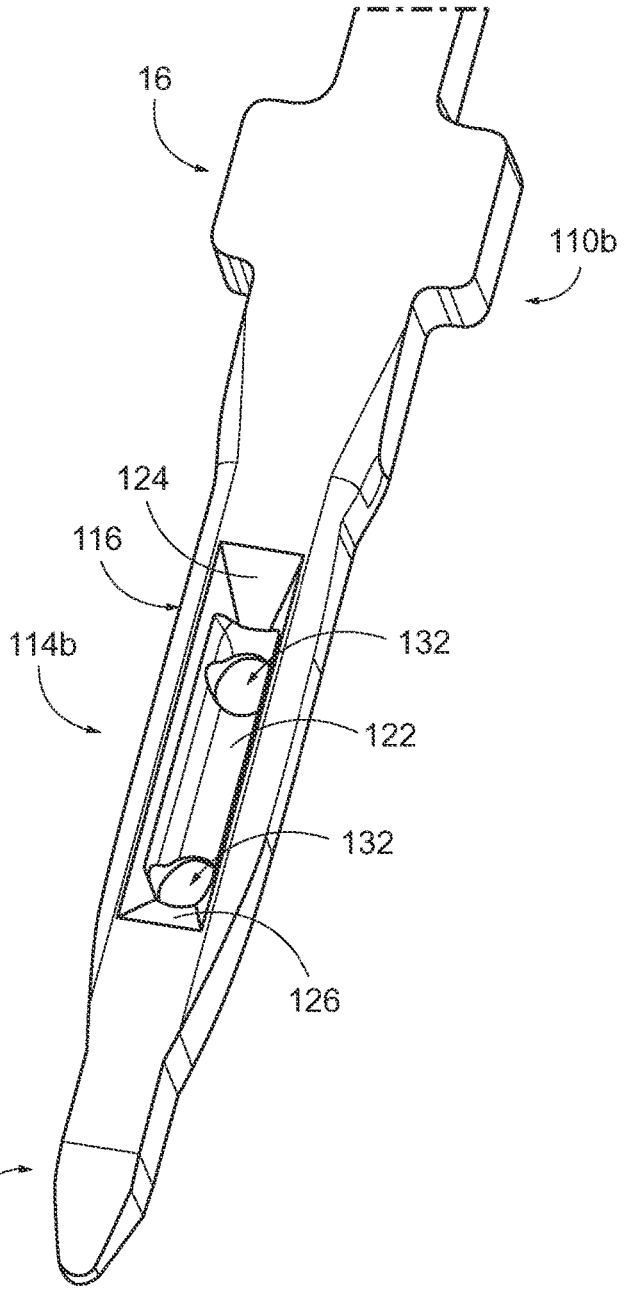
FIG. 13 shows a perspective view of the third embodiment of the fastening section.

In FIGS. 12 & 13, the fastening section 114*b* of the contact 110*b* is shown having a pair of second openings 132 extending through the center section 122. One of the second openings 132 is disposed proximate to the inner ramp section 124, while the other one of the second openings 132 is disposed proximate to the outer ramp section 126.

Figure 14:
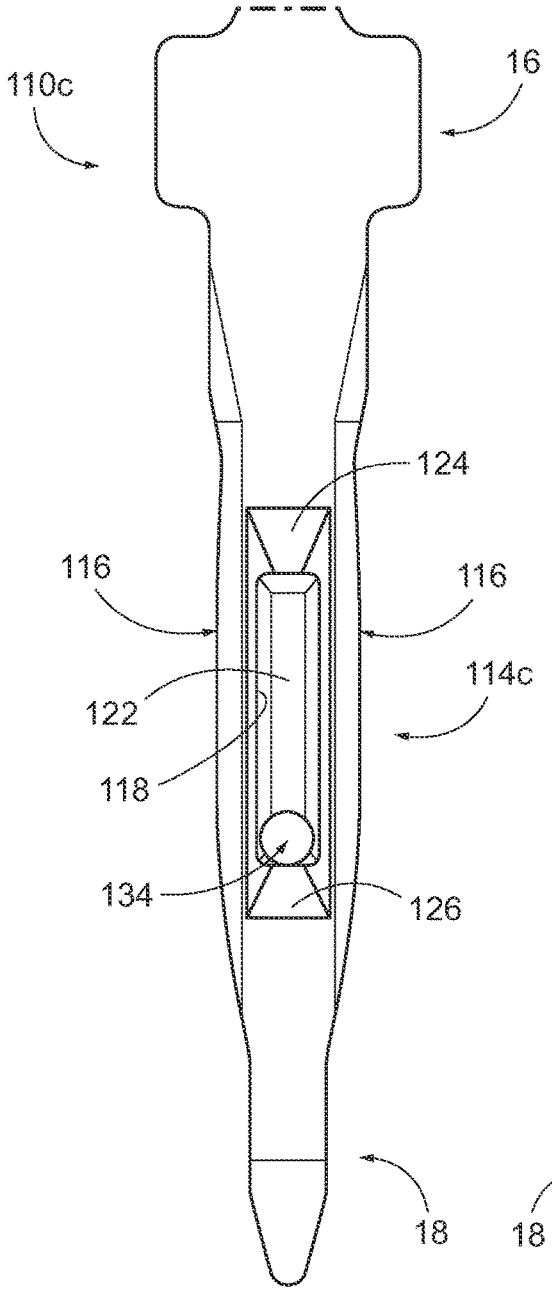
FIG. 14 shows a plan view of a fourth embodiment of the fastening section.
Figure 15:
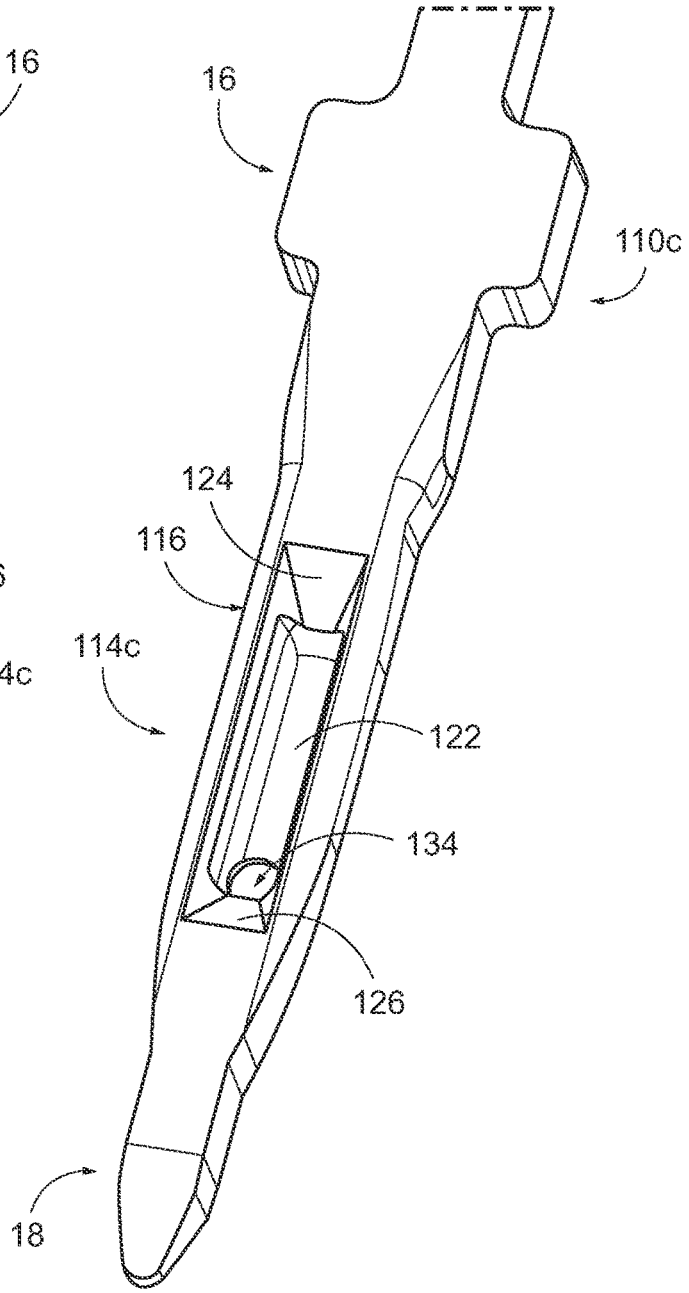
FIG. 15 shows a perspective view of the fourth embodiment of the fastening section.

In FIGS. 14 & 15, the fastening section 114*c* of the contact 110*c* is shown having a singular third opening 134 extending through the center section 122. The third opening 134 has a circular shape and is disposed proximate to the outer ramp section 126. The third opening 134 has a smaller diameter than the circular second opening 132.

Figure 16:
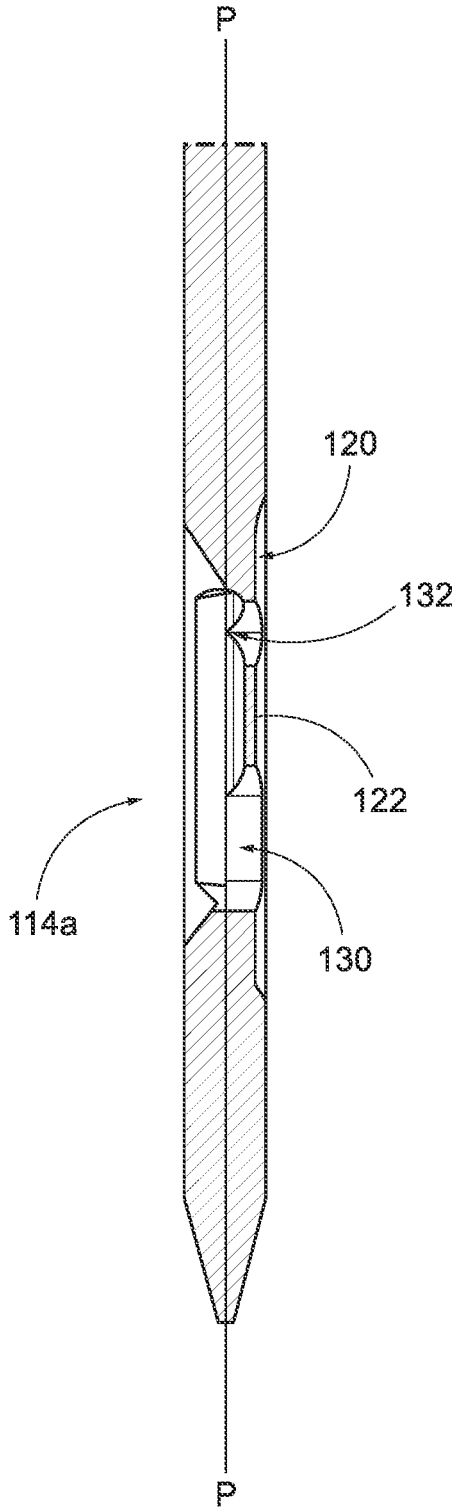
FIG. 16 shows a schematic sectional view of the second embodiment of the fastening section.

Referring now to FIG. 16, the center section 122 (including the openings therein) is shown being disposed below the reference plane P of the fastening section 114. In other words, the center section 122 of the web 120 is offset in the normal direction and is disposed toward the lower surfaces 44 of the beams 116.

It is to be understood that while the foregoing descriptions are focused on contacts for use in making connections to electrically conductive holes of PCBs, the described embodiments can be applied generally to any member that is required to be press-fit into an opening. It is to be further understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. An electrically conductive contact for mounting to a substrate having a hole formed therein, the contact comprising:

a conductive body;

a lead-in section having a tapered tip;

a fastening section integrally joined between the body and the lead-in section and adapted for press-fitting into the hole of the substrate, the fastening section having an opening extending therethrough in a direction normal to a longitudinal axis of the fastening section, the fastening section comprising:

a pair of beams extending in the direction of the longitudinal axis between the body and the lead-in section, the beams having thicknesses in the normal direction with midpoints disposed in a first plane extending in the direction of the longitudinal axis; and a web joined between the pair of beams, the web having first and second surfaces through which the opening extends, the first surface having portions sloping inwardly toward the opening and the second surface being concave in cross-section, at least a portion of the web being offset in the normal direction such that the opening is not intersected by the first plane; and wherein the fastening section is configured such that when the fastening section is press-fit into the hole of the substrate, the beams pivot inward about axes extending parallel to the longitudinal axis.

2. The contact of claim 1, wherein the fastening section is configured such that when the fastening section is press-fit into the hole of the substrate, the beams move laterally inward, toward each other.

3. The contact of claim 1, wherein the fastening section has first and second sides disposed opposite each other in the normal direction, and wherein the web comprises:

an inner ramp portion disposed between the body and the opening, the first surface of the web in the inner ramp portion sloping toward the second side as the inner ramp portion extends toward the opening; and an outer ramp portion disposed between the opening and the lead-in section, the first surface of the web in the outer ramp portion sloping toward the first side as the outer portion extends toward the lead-in section.

4. The contact of claim 3, wherein the web further comprises a center portion joined between the inner and outer ramp portions, the first surface of the web in the center portion extending in a second plane parallel to the longitudinal axis.

5. The contact of claim 4, wherein the opening extends through the center portion of the web.

6. The contact of claim 3, wherein the first surface of the web in the inner ramp portion is planar and the first surface of the web in the outer ramp portion is planar.

7. The contact of claim 3, wherein the beams bow outwardly from the lead-in section and have an inner surface and an outer surface.

8. The contact of claim 7, wherein each of the inner surfaces of the beams has a center portion disposed between inner and outer portions, the inner portion being disposed toward the body and the outer portion being disposed toward the lead-in section, and wherein in the direction of the longitudinal axis, the center portions are substantially straight and the inner and outer portions are arcuate.

9. The contact of claim 1, wherein the fastening section has a plurality of openings extending therethrough in a direction normal to a longitudinal axis of the fastening section, and wherein the openings extend through the portion of the web that is offset in the normal direction such that the openings are not intersected by the plane.

10. The contact of claim 1, wherein the web has a center portion disposed between a pair of ramp portions that include the inwardly-sloping portions of the first surface, which are planar and are disposed at angles to the first plane, respectively, and wherein the center portion is offset in the normal direction such that the center portion is not intersected by the first plane.

11. The contact of claim 10, wherein a plurality of openings extends through the center portion of the web.

12. The contact of claim 11, wherein a first opening is disposed proximate to a first one of the ramp portions and a second opening is disposed proximate to a second one of the ramp portions, and wherein the first surface of the web between the first and second openings is planar and in a second plane parallel to the longitudinal axis.

13. The contact of claim 11, wherein at least one of the openings is circular.

14. The contact of claim 13, wherein one of the openings is circular and one of the openings is elliptical.

15. The contact of claim 10, wherein the inwardly-sloping portions of the first surface in the ramp portions are each disposed at an angle of about 20 degrees.

16. The contact of claim 1, wherein the body comprises an elongated pin joined to a shoulder, and wherein the pin has a circular cross-section.

17. The contact of claim 1, wherein the body comprises a shoulder joined to an elongated blade having opposing planar surfaces and a beveled free end.

18. The contact of claim 1, wherein the lead-in section is one of a plurality of lead-in sections and the fastening section is one of a plurality of fastenings sections, and wherein the body is joined to each of the fastening sections and each lead-in section is joined to one of the fastening sections.

19. The contact of claim 1, wherein the contact is comprises a copper alloy.

* * * * *